US006992641B1

(12) United States Patent
Sanelli

(10) Patent No.: US 6,992,641 B1
(45) Date of Patent: Jan. 31, 2006

(54) SYMMETRY PLANE ANTENNA SYSTEM

(75) Inventor: John Sanelli, Seven Hills, OH (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 10/694,164

(22) Filed: Oct. 27, 2003

(51) Int. Cl.
*H01Q 21/00* (2006.01)

(52) U.S. Cl. ..... 343/893; 343/729

(58) Field of Classification Search ..... 343/725, 343/729, 756, 893

See application file for complete search history.

(56) References Cited

U.S. PATENT DOCUMENTS

| | | | | |
|---|---|---|---|---|
| 6,816,116 | B2 * | 11/2004 | Chen | 342/372 |
| 2004/0192233 | A1 * | 9/2004 | Mitzlaff | 455/127.1 |
| 2004/0209611 | A1 * | 10/2004 | Van Erven | 455/422.1 |

OTHER PUBLICATIONS

Levent Gurel and Ugur Oguz, "The Effects of the Antenna Separation and Polarization on the Simulation Results of Transmitter-Receiver-Transmitter-Configured-Ground-Penetrating Radars," Mar. 28, 2001.

Levent Gurel and Ugur Oguz, "Optimization of the Transmitter-Receiver Separation in the Ground-Penetrating Radar," IEEE Transactions on Antennas and Propagation, vol. 51, No. 3, Mar. 2003.

* cited by examiner

*Primary Examiner*—Shih-Chao Chen
(74) *Attorney, Agent, or Firm*—Tucker Ellis & West LLP

(57) ABSTRACT

A wireless telecommunications device is disclosed including a first antenna element for transmitting and receiving a first wireless telecommunications signal and a second antenna element for transmitting and receiving a second wireless telecommunications signal. A radio transceiver is provided for generating the first and second wireless telecommunications signals. The radio transceiver is configured for generating the first and second wireless telecommunications signals on substantially the same wireless band in such a way as to produce phase cancellation along a predetermined boundary. Preferably, the predetermined boundary is a plane of symmetry between the first and second antenna elements.

14 Claims, 3 Drawing Sheets

SYMMETRY PLANE ANTENNA SYSTEM

BACKGROUND

This invention is directed to the field of wireless networking, with particular applicability to rollouts in which there is a large quantity of wireless traffic in a given operational area. It is becoming increasingly common to implement wireless local area networks (WLANs) in addition to or in place of traditional LANs. In a traditional LAN, each client device, e.g. a personal computer etc., requires a physical, hard-wired connection to the network. However, with a WLAN, each client device includes a wireless capability (such as an insertable, embedded card or fully integrated capability) for wirelessly communicating with the network via an access point (AP) that includes an antenna, a transceiver and a hard-wired connection to the network. In this way, users may carry their hand-held devices and laptop computers within a physical area and still maintain a network connection.

However, in "crowded" enterprise rollouts, it can be difficult for a large number of users to simultaneously access the network due to the contention-based protocol used. Accordingly, it has been contemplated that multiple wireless channels can be used for allowing user access. Three non-overlapping channels have been allocated in the 2.4 GHz band, and eleven channels in the 5 GHz band. Using multiple available channels, an AP may be implemented in a single-package topology that enables simultaneous transmission and reception on nearby frequency channels at the same interval in time. A problem inherent with such a topology is a high degree of self-interference between signals on adjacent channels, resulting in poor quality of service. It is thus desirable to provide signal isolation between each transceiver in the AP. Depending on the tranceiver architecture, there will be an additional antenna-to-antenna isolation requirement that must be met to achieve the overall required signal isolation.

A special problem arises when a multiplicity of antenna elements used to support a single unit, multichannel AP are in close proximity to each other and whose element-to-element isolation is low. The overall requirement is to cover a large (omnidirectional) area with all of the AP channels, either in concert or sectorially. Absorber materials are known for providing antenna isolation, but these materials are expensive, bulky, and otherwise unsuitable as the sole method for achieving the required isolation. Physical separation between the antennas is also a solution, however this would lead to a product that could not be neatly integrated into a single reasonably sized housing. This is problematic since current multichannel access point products are migrating toward single package topologies that simultaneously transmit and receive on nearby frequency channels, and thus are prone to a high degree of self-interference.

The problem of antenna isolation can be also addressed by the use of "smart" antennas, in which the antenna can be "steered" toward a particular client or group of clients to send and receive signals and yet maintain high isolation from other steered beams. Directional antennas with high front-to-back ratios (F/B ratio) can also be used in some applications, such as when a geometrically isolated area must be covered. However, a special case arises when a two channel system is desired. These might be two channels in the 2.4 GHz band or two channels in the 5 GHz band. In these situations, one desires a hemispherical radiation pattern so that the coverage area can be divided into two sectors. The isolation must still be high to allow simultaneous operation of those two transceivers.

SUMMARY

The difficulties and drawbacks of previous-type implementations are addressed by the presently-disclosed embodiments in which a wireless telecommunications device includes a first antenna element for transmitting and receiving a first wireless telecommunications signal and a second antenna element for transmitting and receiving a second wireless telecommunications signal. A radio transceiver is provided for generating the first and second wireless telecommunications signals. The radio transceiver is configured for generating the first and second wireless telecommunications signals on substantially the same wireless band in such a way as to produce phase cancellation along a predetermined boundary. Preferably, the predetermined boundary is a plane of symmetry between the first and second antenna elements.

As will be realized, the invention is capable of other and different embodiments and its several details are capable of modifications in various respects, all without departing from the invention. Accordingly, the drawings and description are to be regarded as illustrative and not restrictive.

DETAILED DESCRIPTION OF THE EMBODIMENTS

Particular reference is now made to the figures, where it is understood that like reference numbers refer to like elements. As disclosed herein, the preferred wireless telecommunications device has particular applicability as used with a wireless access point for a wireless local area network, in which the wireless access point is in communication with a plurality of wireless mobile clients. However, it should be appreciated that the disclosed concept can be adapted for use with any other suitable wireless telecommunications device, without departing from the novel concept disclosed herein.

Figure 1:
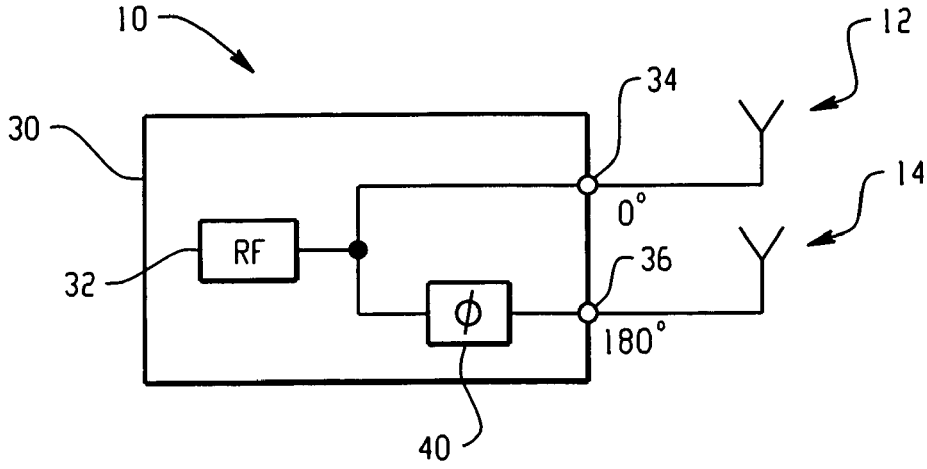
FIG. 1 illustrates the radio transceiver arrangement in accordance with the preferred embodiments.

FIG. 1 shows a wireless telecommunications device 10 that includes a first antenna element 12 for transmitting and receiving a first wireless telecommunications signal. A second antenna element 14 is provided for transmitting and receiving a second wireless telecommunications signal. A radio transceiver 30 is provided for generating the first and second wireless telecommunications signals. The radio transceiver 30 is configured for generating the first and second wireless telecommunications signals on a substantially predetermined wireless band in such a way as to produce phase cancellation of the first and second signals along a predetermined boundary, as will be set forth in greater detail hereinbelow.

Figure 2:
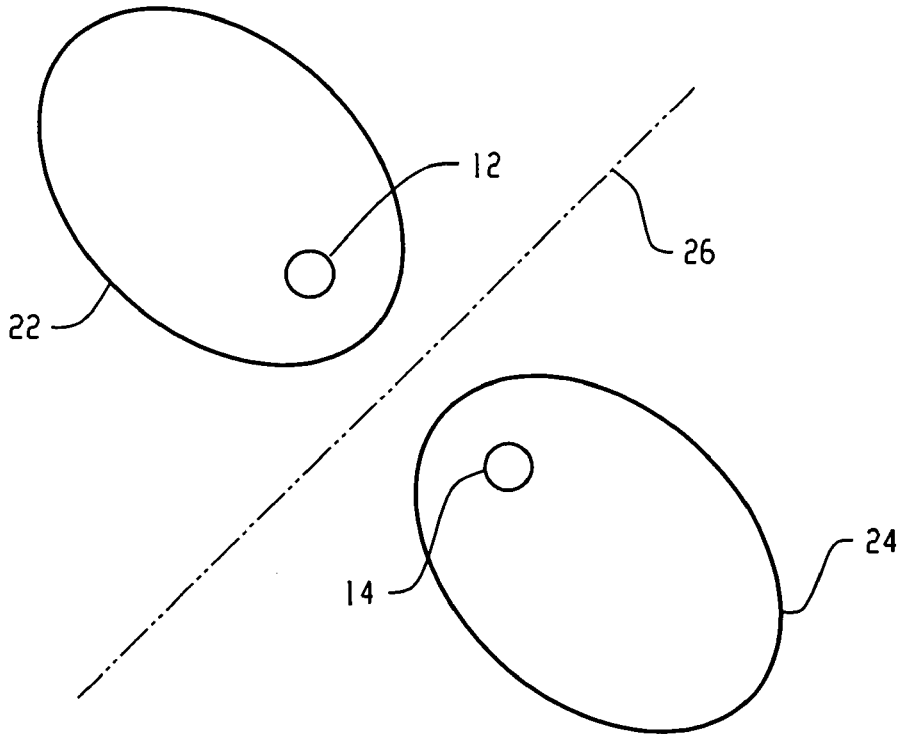
FIG. 2 depicts the antenna configuration for a wireless telecommunications device in accordance with the preferred embodiments.

As shown in FIG. 2, each antenna 12, 14 will propagate a respective wireless signal coverage area 22, 24 corresponding to the first and second wireless telecommunications signals, within which area wireless telecommunications can be exchanged. In the preferred embodiment, a radio transceiver 30 is configured for generating the first and second wireless telecommunications signals on substantially the same wireless band but substantially 180 degrees out of phase. By maintaining this desirable phase shift, as especially shown in FIG. 2, the boundary of phase cancellation for each of the first and second signals is the "symmetry plane" 26 between the first and second antenna elements 12, 14. The symmetry plane 26 is a null plane for the signal in which destructive interference occurs between some components of the wireless telecommunications signals.

As shown in FIG. 1, the a radio transceiver 30 comprises a radio circuit 32 for generating the first and second wireless telecommunications signals. The signals are divided so as to be directed to respective first and second ports 34, 36, which are connected to the respective first and second antenna elements 12, 14. A phase shifter 40 is provided in line with one of the signal paths so as to produce a phase shift in one of the first and second wireless telecommunications signals, preferably of 180 degrees, as indicated in the figure. In this way, the phase shifter produces phase cancellation of the first and second signals along the predetermined boundary, i.e. the symmetry plane. The phase shift can be produced in any suitable manner. In one embodiment, it is contemplated to use a phase shifter as described in U.S. Pat. No. 6,621,377 (assigned to Paratek Microwave, Inc., Columbia, Md.). This type of phase shifter uses a low-loss tunable dielectric materials and a plurality of other components to achieve precision phase control. Other phase shifters could use other technologies or components (e.g., one or more varactors). Using precision phase control, a very tight phase tolerance can be maintained, thereby allowing a high degree of signal isolation along the symmetry plane. Lesser degrees of phase tolerance will achieve lesser degrees of signal isolation.

As a special feature, the preferred system can be readily adapted to a multi-channel embodiment so as to transmit and receive over a number of wireless frequency bands. In this way, the first and second antenna elements 12, 14 are a first pair of antenna elements that operate substantially on a first wireless band. This first pair of antenna elements is one of a plurality of pairs of antenna elements. Each of the respective pairs of antenna elements 12, 14 are adapted to operate over a respective plurality of wireless bands. Each pair operates in such a way as to produce phase cancellation of the respective signals along a respective symmetry plane, corresponding to that respective antenna pair.

Figure 3:
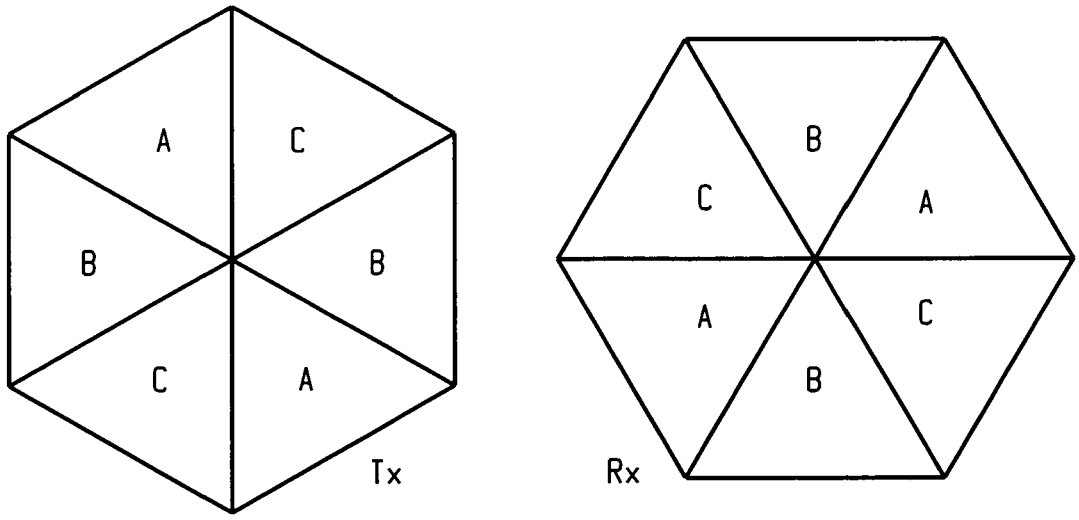
FIG. 3 illustrates a configuration of a multi-channel wireless telecommunications device in accordance with an embodiment of the preferred system.
Figure 4:
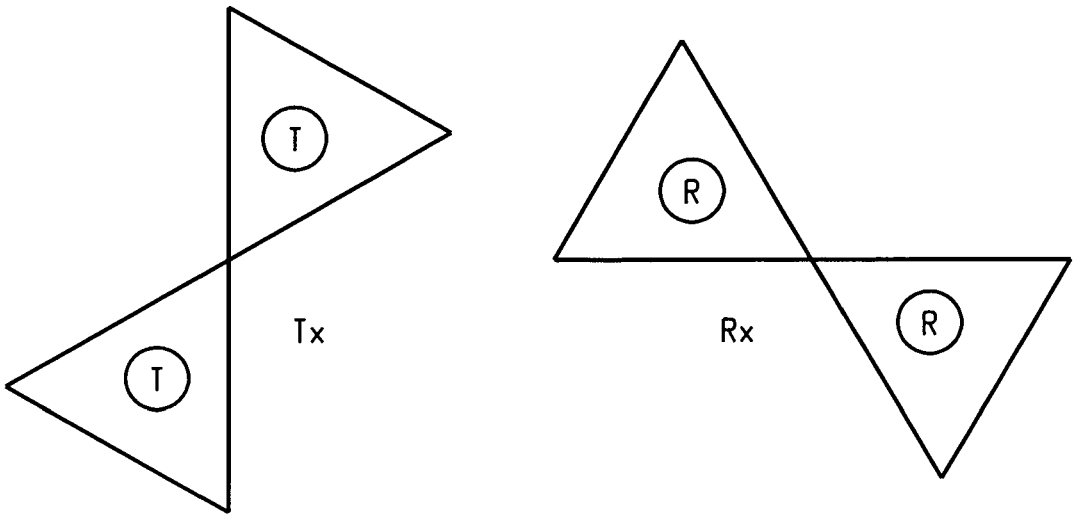
FIG. 4 illustrates an alternate configuration of a multi-channel wireless telecommunications device in accordance with another embodiment of the preferred system.

As shown in FIG. 3, in a multi-channel embodiment, an antenna structure is disclosed in which a plurality of antenna pairs are arranged in six sectors in a generally hexagonal configuration. As shown, two hexagonal antenna structures are provided, one for transmitting channels (Tx) and one for receiving channels (Rx). In the Tx hexagonal structure, a first antenna pair A, A is provided to transmit over a first frequency band, a second antenna pair B, B is provided to transmit over a second frequency band, and a third antenna pair B, B is provided to transmit over a third frequency band. For example, each frequency band may be a channel in accordance with the IEEE 802.11 g standard—low, middle and high channels respectively. In this way, these respective transmitting antenna pairs do not interfere with each other. In the Rx hexagonal structure, corresponding antenna pairs are provided but oriented so that respective antenna pairs are perpendicular to each other. As shown in FIG. 4, for a given channel, the respective corresponding Tx and Rx antenna pairs are at right angles. In this way, further interference is controlled by not having the signal from the Tx antenna pair propagate into the Rx antenna pair. Of course it is appreciated that multipath can cause propagation from the Tx antenna pair into the Rx antenna pair despite the use of this invention. This primary intent of this invention is to address non-multipath propagation. The wireless frequency bands over which the antenna pairs operate can be wireless frequency sub-bands selected from 2.4 GHz and 5 GHz wireless bands. Of course it is appreciated that any other suitable wireless band can also be employed without departing from the embodiments.

Figure 5A:
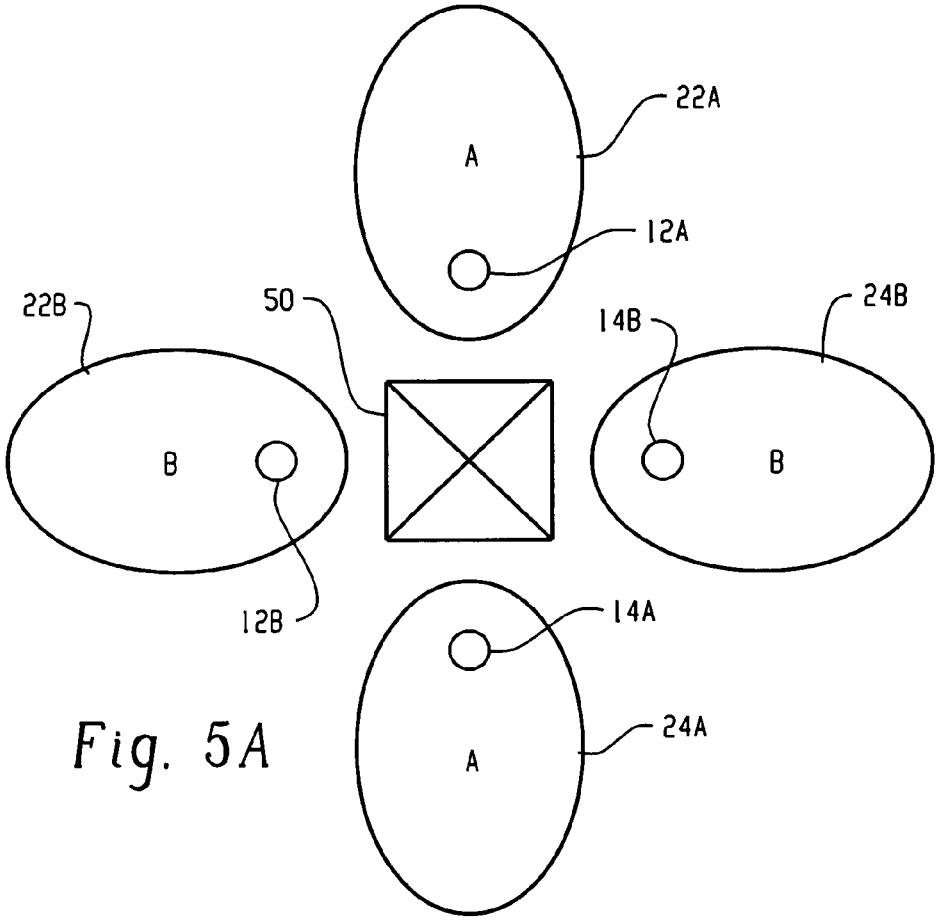
FIGS. 5A and 5B are respective overhead and oblique views of another alternate configuration of a multi-channel wireless telecommunications device in accordance with another alternate embodiment of the preferred system.
Figure 5B:
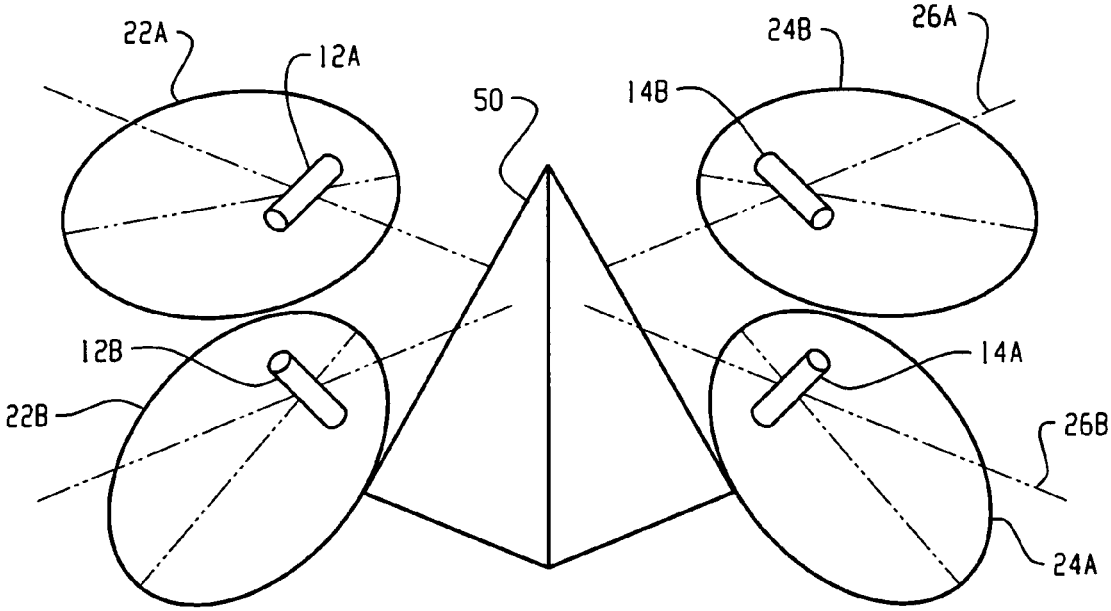

Since the symmetry plane is a "null plane" for signals on the wireless frequency of an antenna pair, it is further contemplated to locate one or more additional antenna elements within the symmetry plane between the first and second antenna elements. In this way, it is possible to transmit and receive a respective wireless telecommunications signal on a wireless frequency different from the wireless frequency of the first and second antenna elements of the antenna pair. As shown in FIGS. 5A and 5B, a first pair of antenna elements 12A, 14A both operate over a first wireless frequency of e.g. 2412 MHz and service their own respective coverage areas 22A, 24A, isolated from a second pair of antenna elements 12B and 14B by their respective symmetry plane 26A. A second pair of antenna elements 12B, 14B both operate over a second wireless frequency of e.g. 2442 MHz and service their own respective coverage areas 22B, 24B, and are isolated from the first pair by their own respective symmetry plane 26B, perpendicular to the first symmetry plane 26A. It is contemplated that one or more additional antenna elements 50 are located at a junction of the symmetry planes of the respective first and second pairs of antenna pairs. A single antenna element 50 can be provided for transmitting and receiving a respective wireless telecommunications signal on a substantially predetermined wireless frequency different from the wireless frequencies of the first and second pairs of antenna elements. For example, the single antenna element 50 can operate on a third frequency of 2484 MHz, and be used to provide close-in coverage so as to not interfere with the other antenna pairs. The additional antenna elements 50 and the entire antenna system benefit from the resultant isolation related to the the location of the additional antenna elements 50 at or near symmetry planes 26A and 26B. Of course it is appreciated that the phase shift of the phase shifter 40 can be dynamically adjusted to accommodate various permutations of a plurality of wireless frequencies.

As described hereinabove, this invention solves many problems associated with previous type systems. However, it will be appreciated that various changes in the details, materials and arrangements of parts which have been herein described and illustrated in order to explain the nature of the invention may be made by those skilled in the area within the principle and scope of the invention will be expressed in the appended claims.

I claim:

1. A multi-channel wireless telecommunications device comprising:

a first pair of antenna elements, for transmitting and receiving a first pair of wireless telecommunications signals over a first predetermined wireless band;

a second pair of antenna elements, for transmitting and receiving a second pair of wireless telecommunications signals over a second predetermined wireless band;

a radio transceiver for generating the respective first and second pairs of wireless telecommunications signals, wherein the radio transceiver is configured for generating the respective pairs of wireless telecommunications signals in such a way as to produce phase cancellation along respective predetermined boundaries.

2. The multi-channel wireless telecommunications device of claim 1 wherein the radio transceiver is configured for generating the respective pairs of wireless telecommunications signals on substantially the same respective wireless bands but substantially 180 degrees out of phase.

3. The multi-channel wireless telecommunications device of claim 1 wherein the predetermined boundaries of phase cancellation of the respective pairs of signals are the symmetry planes between the respective pairs of antenna elements.

4. The multichannel wireless telecommunications device of claim 1 wherein the first and second predetermined wireless bands are wireless frequency sub-bands selected from 2.4 GHz and 5 GHz wireless bands.

5. The multi-channel wireless telecommunications device of claim 1 wherein the radio transceiver comprises a radio circuit for generating the first and second pairs of wireless telecommunications signals and a phase shifter to produce a phase shift in one of each of signals in the first and second pairs of wireless telecommunications signals so as to produce phase cancellation the predetermined boundaries.

6. The multichannel wireless telecommunications device of claim 1 wherein the wireless telecommunications device is a multi-channel wireless access point for a wireless local area network, wherein the multi-channel wireless access point is in communication with a plurality of wireless mobile clients.

7. The multichannel wireless telecommunications device of claim 1 wherein the first and second pairs of antenna elements are ones of a respective plurality of pairs of antenna elements, for transmitting and receiving respective pairs of wireless telecommunications signals over respective predetermined wireless bands.

8. The multi-channel wireless telecommunications device of claim 1 wherein the first and second pairs of antenna elements are configured so that as one of the first and second pairs of antenna elements are transmitting a wireless signal, the respective other the first and second pairs is receiving a wireless signal.

9. The multi-channel wireless telecommunications device of claim 1 further comprising at least one additional antenna element, located at a junction of the symmetry planes of the respective first and second pairs of antenna elements, for transmitting and receiving a respective wireless telecommunications signal on a substantially predetermined wireless band different from the wireless bands of the first and second pairs of antenna elements.

10. A wireless telecommunications device comprising:

a first antenna element for transmitting and receiving a first wireless telecommunications signal;

a second antenna element for transmitting and receiving a second wireless telecommunications signal;

a radio transceiver for generating the first and second wireless telecommunications signals, wherein the radio transceiver is configured for generating the first and second wireless telecommunications signals on a substantially predetermined wireless band in such a way as to produce phase cancellation of the first and second signals along a predetermined boundary; and at least one additional antenna element, located in a symmetry plane between the first and second antenna elements, for transmitting and receiving a respective wireless telecommunications signal on a substantially predetermined wireless band different from the wireless band of the first and second antenna elements;

wherein the predetermined boundary of phase cancellation of the first and second signals is the symmetry plane between the first and second antenna elements.

11. A wireless telecommunications device comprising:

a first antenna element for transmitting and receiving a first wireless telecommunications signal;

a second antenna element for transmitting and receiving a second wireless telecommunications signal; and a radio transceiver for generating the first and second wireless telecommunications signals, wherein the radio transceiver is configured for generating the first and second wireless telecommunications signals on a substantially predetermined wireless band in such a way as to produce phase cancellation of the first and second signals along a predetermined boundary;

wherein the first and second antenna elements are a first pair of antenna elements, operating substantially on a first predetermined wireless band, and wherein the first pair of antenna elements is one of a plurality of pairs of antenna elements.

12. The wireless telecommunications device of claim 11 wherein each of the respective pairs of antenna elements are adapted to operate over a respective plurality of predetermined wireless bands in such a way as to produce phase cancellation of the respective signals along the respective predetermined boundary.

13. The wireless telecommunications device of claim 12 wherein the plurality of predetermined wireless bands are wireless frequency sub-bands selected from 2.4 GHz and 5 GHz wireless bands.

14. The wireless telecommunications device of claim 11 wherein each of the respective pairs of antenna elements are configured so that as one of the respective pairs of antenna elements are transmitting a wireless signal, at least one of the respective other pairs is receiving a wireless signal.

* * * * *